United States Patent [19]

Roccaforte

[11] 4,127,229

[45] Nov. 28, 1978

[54] FLIP TOP DISPENSER BOX

[75] Inventor: Harry I. Roccaforte, Western Springs, Ill.

[73] Assignee: Champion International Corporation, Stamford, Conn.

[21] Appl. No.: 857,098

[22] Filed: Dec. 5, 1977

[51] Int. Cl.[2] ..... B65D 5/54; B65D 17/00

[52] U.S. Cl. ..... 229/44 CB; 206/626; 225/48

[58] Field of Search ..... 225/48, 49, 50; 206/630, 604, 623, 621, 626; 229/44 CB

[56] References Cited

U.S. PATENT DOCUMENTS

| | | | |
|---|---|---|---|
| 2,336,842 | 12/1943 | Broerm et al. | 225/49 X |
| 2,361,597 | 10/1944 | Buttery | 229/44 CB |
| 2,963,214 | 12/1960 | Leone et al. | 229/44 CB |
| 3,018,942 | 1/1962 | Armeson | 206/626 |
| 3,128,025 | 4/1964 | Buttery et al. | 225/48 |
| 3,137,424 | 6/1964 | Finn et al. | 225/48 |
| 3,531,032 | 9/1970 | Miles, Jr. | 225/48 |
| 3,722,767 | 3/1973 | Struble | 225/49 |
| 3,777,957 | 12/1973 | Buttery | 225/50 |
| 3,790,053 | 2/1974 | Schiano | 225/48 |

*Primary Examiner*—Davis T. Moorhead
*Attorney, Agent, or Firm*—Evelyn M. Sommer

[57] ABSTRACT

A flip top dispenser box which is sealed along lines of weakness joining an upper and lower portion of the opposed side walls of the box. The seal is broken to gain access to the contents of the box by rotating the top or cover of the box to sever the lines of weakness.

4 Claims, 7 Drawing Figures

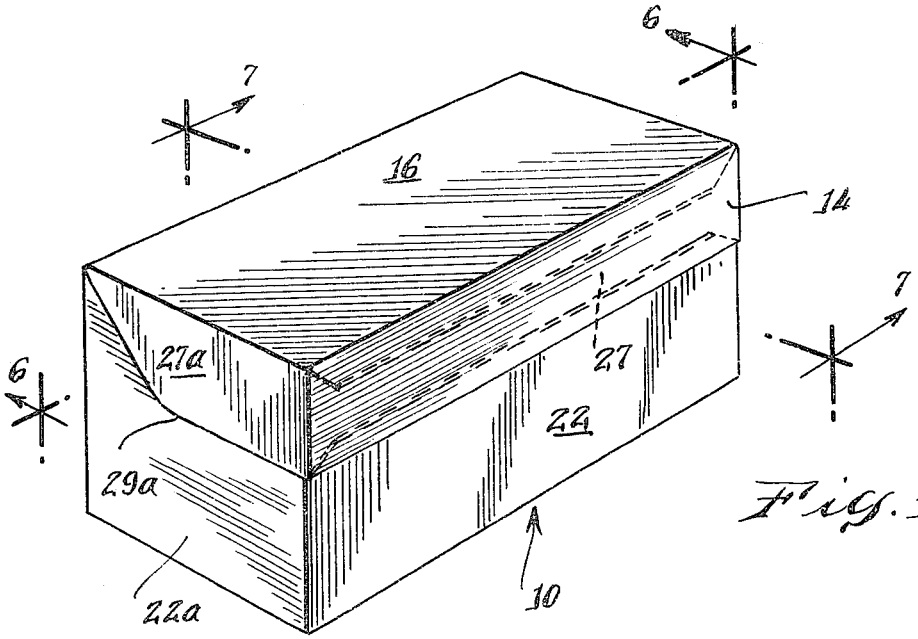
Fig. 1.
Fig. 2.
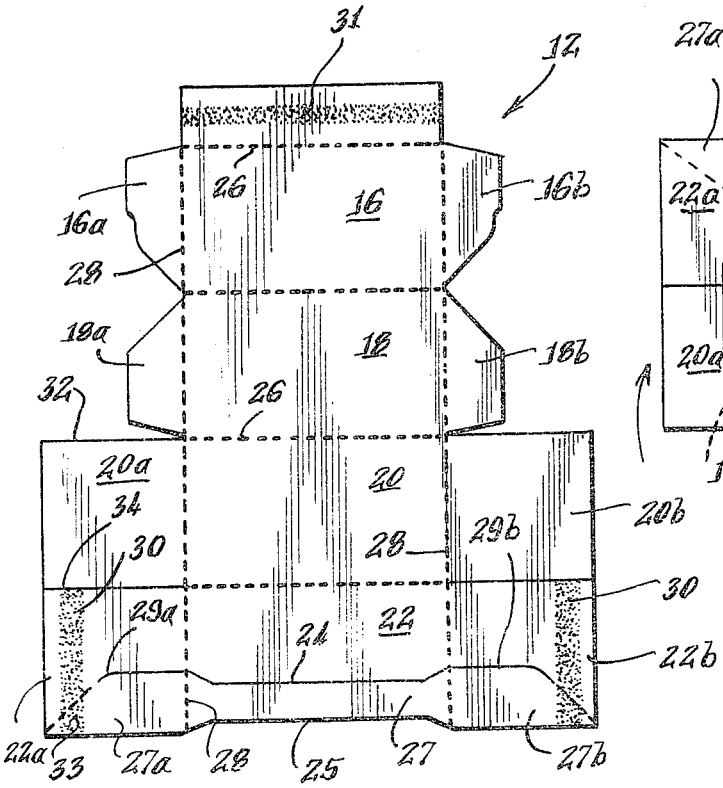
Fig. 3.
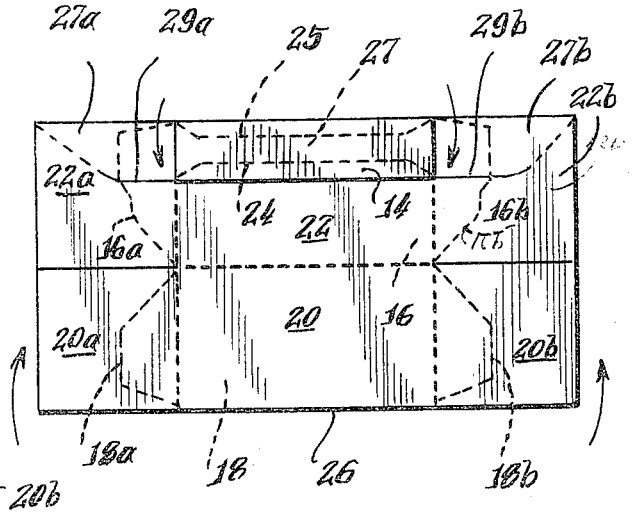

FLIP TOP DISPENSER BOX

BACKGROUND OF THE INVENTION

1. Field of the Invention

This invention relates to an end seal flip top box, and more particularly, a box designed to contain a roll of film such as wax paper, foil, plastic, rolled confections and the like, which is used to dispense portions of the film after the box seal is broken.

2. Description of the Prior Art

Many cartons or boxes have been produced to contain and dispense film from a roll housed within the box. Such boxes are usually equipped with a cutting member such as a strip of metal having a serrated edge over which the film may be drawn for cutting the film to a desired length. The box must be opened so that the end of the film may be grasped and threaded from the interior of the box over the serrated cutting edge. The box must then be reclosable to apply pressure on the film strip removed from the roll to hold it against further unwinding during the cutting operation. Exemplary patents illustrating such boxes are U.S. Pat. Nos. 3,137,424; 3,531,032; 3,722,767; 3,128,025; and 3,777,957.

As the majority of the above patents show, the dispenser box is usually provided with a tear strip which when removed, enables the box to be opened. When intact, the tear strip seals the box, protecting the contents or film roll from contamination.

U.S. Pat. No. 3,531,032, however, uses a different approach to effect the requisite seal. In lieu of a tear strip, which increases manufacturing costs and adds to the expense of the box, the cover is connected to the side walls by weakened lines of separation, when the box blank is formed. The cover thus seals the contents of the box, but when raised, separates from the side walls to break the seal. Such a construction results in the elimination of the tear strip. The box is filled from the side and flaps forming the side wall are then sealed to enclose the contents.

The box of this invention relates to a similar construction although made from an entirely different blank. The undesirable tear strip seal is eliminated, and in addition, a flip top construction is provided wherein a portion of the side walls of the box remain connected to the cover after the seal is broken.

The sidewall closure effected by the flip-top construction materially aids in precluding contaminants and other unwanted materials from gaining access to the interior of the box through open and flexed top edges once the seal is broken and the cover reclosed.

SUMMARY OF THE INVENTION

Accordingly, this invention provides a flip top dispenser box of the type described, formed from a single, integral planar paperboard blank which is folded into a rectangular parallelopiped.

The blank for forming the rectangular box has a top panel forming a cover. Hingedly connected to opposite sides of the cover is an outer front panel and a back panel. Hingedly connected to the back panel is a bottom panel. An outer front panel is hingedly connected to the bottom panel and has connected along the bottom edge thereof by weakened lines of separation at selected portions thereof, an inner front panel. Side flaps extend laterally from the opposite side edges of each panel except the outer front panel attached to the top or cover panel.

The box is formed by folding the panels and flaps about horizontal and vertical score lines, respectively, and adhesively securing the rear surface of the inner front panel to the outer surface of the outer front panel at the top of the blank to form a rectangular box. The roll of film is then inserted into the rectangular box from a side thereof and the side flaps of the panels folded at right angles into overlapping relation and sealed.

The outer top front panel overlaps the top edge of the lower front panel so that the outer top front panel can be grasped with the fingers and rotated backwards with the top panel or cover to sever the weakened lines of separation now forming the box seal between the cover and side walls, exposing the roll in the box. A length of film can be unwound, and the cover closed. The film can then be torn laterally along a serrated edge on a suitable portion of the front wall to cut the film from the roll.

BRIEF DESCRIPTION OF THE DRAWINGS

Further objects and advantages of the invention will become apparent from the following description and claims, and from the accompanying drawings, wherein:

FIG. 1 is a perspective view of the flip top dispenser box of the present invention;

FIG. 2 is a plan view of the blank for forming the box of FIG. 1;

FIG. 3 is a plan view of the blank of FIG. 2 being folded to form the box of FIG. 1;

DETAILED DESCRIPTION OF THE PREFERRED EMBODIMENT

Figure 4:
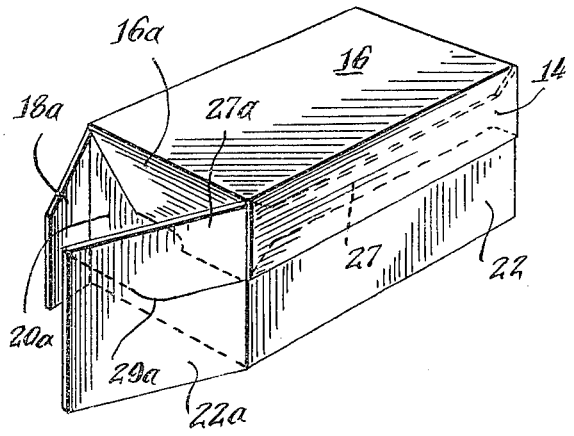
FIG. 4 is a perspective view of the folded blank prior to being sealed from the side.

Referring now to the drawings in detail, wherein like numerals indicate like elements throughout the several views, the box 10 of the present invention if formed from a single, planar, unitary paperboard blank 12.

Blank 12 includes five vertically aligned substantially rectangular panels 14, 16, 18, 20 and 22 joined to each other by horizontal score lines 26. Each rectangular panel 16, 18, 20 and 22 includes a left and right laterally extending flap designated *16a, 16b* . . . *22a, 22b*, respectively, corresponding to each panel 16 . . . 22 to which it is joined. The flaps *16a, 16b* . . . *22a, 22b* are joined to its corresponding panel 16 . . . 22 by a vertical score line 28.

In addition, the bottom rectangular panel 22 is cut along a substantially horizontal line 24 parallel to its bottom edge 25 to form a separable or detachable panel 27. Panel 27 has opposite flaps *27a, 27b* joined by a vertical score line 28 to the panel. Flaps *27a, 27b* are joined to flaps *22a, 22b*, respectively, by weakened lines of separation *29a, 29b* formed by scoring the blank 12.

To assemble the box 10 from blank 12, the blank is first folded substantially in half about score line 26 connecting panels 18 and 20 as shown in FIG. 3. The panel 14 is then folded downwardly about its score line 26 to overlie panel 27 and has its outer surface adhesively secured to the inner or reverse surface of panel 27 by an adhesive line 31. The panels 16, 18, 20 and 22 are then all folded and pivoted 90° relative to each other about their respective horizontal score lines 26 to substantially form a rectangular enclosure as shown in FIG. 4.

Panel 22 forms the lower front of box 10 and is disposed in a plane perpendicular to panel 20, which forms the bottom of box 10. Panel 18 is also disposed in a plane perpendicular to panel 20 and parallel to panel 22 to form the back of box 10. Panel 16 is disposed in a plane parallel to panel 20 to form a top or cover for box 10. Panel 14 is disposed in a plane parallel to back panel 18, to form the upper outer front panel which overlies the top edge of lower front panel 22. Panel 27, being secured to the inner surface of panel 14, forms an upper inner front panel.

Figure 5:
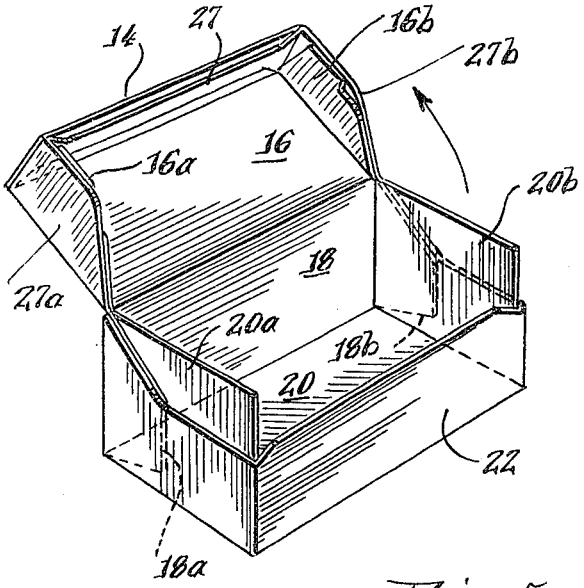
FIG. 5 is a perspective view of the box of FIG. 1 being opened.

The box is then filled with a roll of film through either open side. Then, as shown in FIG. 4, each of the side flaps 16*a*, 16*b* . . . 22*a*, 22*b* and 27*a*, 27*b* of each panel 16 . . . 24 and 27, respectively, is pivoted 90° about its respective panel. Flaps 22*a* and 22*b* overlap flaps 18*a* and 18*b*, respectively, to form lower, opposite sides of box 10. Glue or adhesive 30 is applied to the facing surfaces of side flap pairs 18*a*, 22*a* and 18*b*, 22*b* to preclude blank 12 from unfolding. Flaps 20*a* and 20*b* being unsecured at their vertically spaced parallel edges 32, 34 are free to pivot about their joinder hingelines 28 and are disposed in an upright condition abutting the secured flap pairs 18*a*, 22*a* and 18*b*, 22*b*, respectively. As shown in FIG. 5, the height of each flap 20*a*, 20*b* is the same as the height of back panel 10 and serve to substantially form solid side walls between which the film is disposed.

When folded, after the box 10 is filled, the side flaps 27*a*, 27*b* form the upper, opposite sides of box 10, which overlie side flaps 16*a*, 16*b*, respectively, of cover 16. Adhesive 33 secures each side flap pair 16*a*, 27*a* and 16*b*, 27*b*, together. Upper side wall portions 27*a*, 27*b* are secured to the lower side wall portions 22*a*, 22*b*, respectively, by the scored lines of weakness 29*a* and 29*b*, respectively. Box 10 is thus completely sealed, as shown in FIG. 1.

Figure 6:
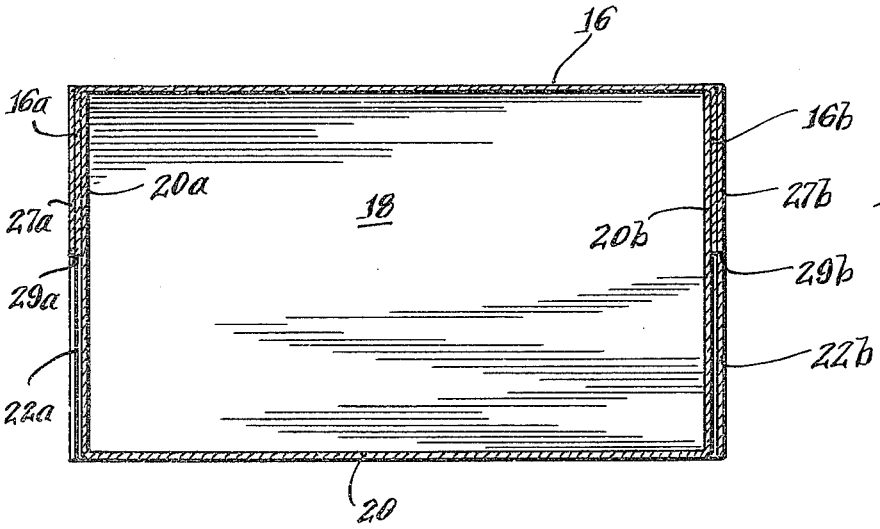
FIG. 6 is a cross-sectional view of the box of FIG. 1 taken substantially along the plane indicated by line 6—6 of FIG. 1.
Figure 7:
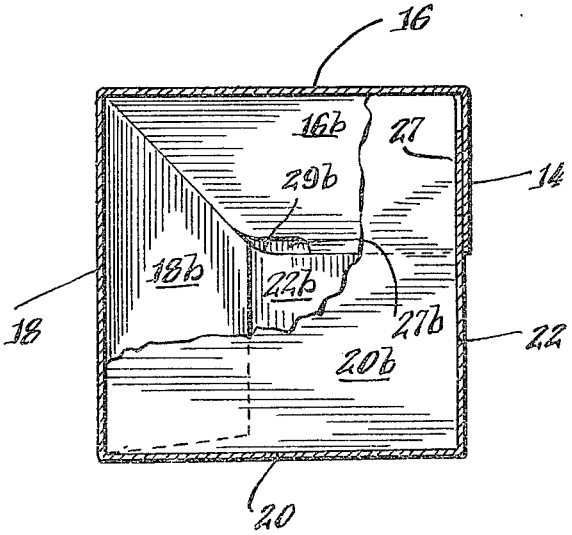
FIG. 7 is a cross-sectional view of the box of FIG. 1 taken substantially along the plane indicated by line 7—7 of FIG. 1.

To open box 10, it is only necessary to grasp the lower edge of upper front panel 14 and rotate the cover 16 backwards as indicated in FIG. 6 causing the lines of weakness 29*a*, 29*b* to separate the upper and lower side wall panels providing access to the interior of box 10. A length of film can then be unwound from the roll R in the box and the cover 16 reclosed. The film will be positioned between the lower edge of panel 14 and the upper edge of panel 22 and can be severed by a conventional serrated cutting bar secured to either the lower edge of panel 14 or upper edge of panel 22 or located at any other convenient location on box 10.

Because of the closure of box 10 occuring along the mating edges of the upper and lower side walls (lines 29*a*, 29*b*) contaminants are virtually precluded from entering box 10, particularly where flaps 20*a*, 20*b* overlap the entire interior side walls.

What is claimed is:

1. A flip top dispenser box comprising:

a front wall (14, 27 and 22), a back wall (18), top (16) and bottom (20) walls, and opposing side walls;

said front wall including a lower member (22) hingedly connected at one end thereof to said bottom wall; a detachable member (27) hingedly and releasably connected to said lower member (22); and a top member (14) overlapping and being adhered to said detachable member (27) and a portion of said lower member (22), one end of said top member (14) having a gripping edge, the other end of said top member (14) being hingedly connected to said top wall (16);

each of said side walls including an inner wall member (20*a* and 20*b*) and hingedly connected to the bottom wall (20), each of said inner side wall members (20*a* and 20*b*) having approximately the same height as said back wall (18), each of said side walls further including an outer wall member (22*a* and 27*a*), (22*b* and 27*b*), each of said outer wall members including a lower portion (22*a* and 22*b*) hingedly connected to the lower member of said front wall (22) and overlapping and being adhered to a portion of its respective inner side wall member (20*a* and 20*b*), each of said outer side walls further including a top portion (27*a* and 27*b*) which is contiguous with, and releasably connected to its respective lower outer side wall portion (22*a* and 22*b*), each top outer side wall portion being hingedly connected to the detachable member (27) of said front wall.

2. A flip top dispenser box as recited in claim 1 in which each of said side walls further includes an intermediate side wall member (16*a*, 18*a* and 16*b*, 18*b*) disposed between its respective inner (20*a* and 20*b*) and outer (22*a*, 27*a* and 22*b*, 27*b*) side wall members, each of said intermediate side wall members including a top portion (16*a* and 16*b*) hingedly connected to said top wall (16) and extending from said top wall (16) toward said bottom wall (20), each of said intermediate side wall members further including a back portion (18*a* and 18*b*) hingedly connected to said back wall (18) and extending from said back wall (18) toward said front wall (27 and 22).

3. A blank for forming a flip top dispenser box comprising a top wall panel (16); a back wall panel (18) hingedly connected to the lower edge of said top wall panel (16); a bottom wall panel (20) hingedly connected to the lower edge of said back wall panel (18); a lower front wall member (22) hingedly connected at one end to said bottom wall member (20); a detachable member (27) hingedly and releasably connected to said lower front wall member (22); an upper front wall member (14) hingedly connected to the top edge of said top wall panel (16), said upper front wall member (14) being adapted to overlap and adhere to said detachable member (27) and a portion of said lower front wall member (22); first and second inner side wall members (20*a* and 20*b*), each of said inner side wall members being hingedly connected to one of the lateral edges of said bottom wall member (20), each of said inner side wall members (20*a* and 20*b*) having approximately the same height as said back wall panel (18); first and second lower outer side wall members (22*a* and 22*b*) each of which is hingedly connected to one of the lateral edges of said upper front wall member (14); and first and second top outer side wall members (27*a* and 27*b*), each of which is contiguous with and releasably connected to one of the lower outer side wall members, (22*a* and 22*b*), each of said top outer side wall members (22*a* and 27*b*) being hingedly connected to the detachable member (27).

4. A blank for forming a flip top dispenser box as recited in claim 3 which further includes first and second upper intermediate side members (16*a* and 16*b*), each of which is hingedly connected to one of the lateral edges of said top wall panel; and first and second rear intermediate side members (18*a* and 18*b*), each of which is hingedly connected to one of the lateral edges of said back wall (20), said upper intermediate side members and said rear intermediate side members being adapted to be sandwiched between their corresponding inner and outer side wall members.

* * * * *